US006376761B1

(12) United States Patent
LaMarra et al.

(10) Patent No.: US 6,376,761 B1
(45) Date of Patent: Apr. 23, 2002

(54) MODULAR MUSICAL INSTRUMENT AMPLIFICATION SYSTEM

(76) Inventors: Frank LaMarra, 7305 Creekview, West Bloomfield, MI (US) 48322; Bruce Egnater, 25550 Colleen St., Oak Park, MI (US) 48237

( * ) Notice: Subject to any disclaimer, the term of this patent is extended or adjusted under 35 U.S.C. 154(b) by 0 days.

(21) Appl. No.: 09/495,221

(22) Filed: Jan. 31, 2000

(51) Int. Cl.[7] ..... G10H 1/32; G10H 5/00
(52) U.S. Cl. ..... 84/670; 381/118
(58) Field of Search ..... 84/600, 644, 670, 84/746; 381/87, 118–120, 124

(56) References Cited

U.S. PATENT DOCUMENTS 4,388,490 A * 6/1983 Spector
4,479,238 A * 10/1984 Spector ..... 381/61
4,481,661 A * 11/1984 Spector
4,509,190 A * 4/1985 Spector
4,936,185 A * 6/1990 Yamaguchi et al. ..... 84/670
5,142,445 A * 8/1992 Sorenson et al.
5,444,676 A * 8/1995 Balsamo et al.
5,488,669 A * 1/1996 Zampini et al.
5,546,273 A * 8/1996 Harris
5,700,966 A * 12/1997 LaMarra
5,834,671 A * 11/1998 Phoenix
5,940,521 A * 8/1999 East et al.
6,052,472 A * 4/2000 Lo
6,111,755 A * 8/2000 Park ..... 361/727

OTHER PUBLICATIONS

Electronic Musician, Feb. 1990, "Yamaha Pro Audio—DSP Factory".*

* cited by examiner

*Primary Examiner*—Jeffrey Donels
(74) *Attorney, Agent, or Firm*—Harness, Dickey & Pierce, P.L.C.

(57) ABSTRACT

A modular amplification system consisting of a plurality of pre-amplifying modules for allowing a user to select at will, a particular module as desired. The modular amplification system includes a chassis which houses a power supply for supplying low and high voltages to each of the pre-amplifying modules, support circuitry and interconnections for accessing the audio and control signals as required. Additionally, each of the pre-amplifying modules is designed, so that it contains the circuitry required for proper amplification of various musical instruments. The pre-amplifying module is selected from a vacuum tube amplifier, an analog and/or digital solid state amplifier, and analog or digital signal processing unit. The pre-amplifying module is then inserted into the chassis by an edge connector and suitable bolts which allows ease of installation and removal. Any combination of different pre-amplifying modules may be used which can then be selected by a user. The modular amplification system can be applied to a rack mounting unit, a self contained unit or a combo unit.

11 Claims, 5 Drawing Sheets

MODULAR MUSICAL INSTRUMENT AMPLIFICATION SYSTEM

BACKGROUND AND SUMMARY OF THE INVENTION

The present invention relates generally to musical instrument amplifiers. More particularly, the invention relates to a modular musical instrument amplifier system that allows the musician to customize his or her amplifier by selecting and installing different modular pre-amplifier units or effect processor units. The units conveniently slide into the amplifier system chassis, so that their respective control knobs are presented on the face of the unit for easy access. Switching circuitry associated with the chassis routes the music signal through one or more of the pre-amplifier/effect's units based on the user's preference.

The musical instrument industry today offers a mind-numbing assortment of different musical instrument amplifiers and effects processors from which a musician may choose. Each different brand and style of amplifier has its own sound and its own following. For example, whereas heavy metal musicians may prefer amplifiers of high power with lots of raw distortion, country musicians may prefer a less powerful, sweeter sound. Similarly, many blues musicians tend to favor more classic or vintage amplifiers that can be overdriven to provide a moderate level of distortion or "crunch." Techno-musicians may prefer yet another sound, characterized by comparatively clean amplification with lots of digital signal processing. In short, there is an amplifier system for virtually every type of sound or music that is popular today.

The wide assortment of available amplifier and effects processor options can make equipment shopping an emotional decision, fraught with compromises. Because no one amplifier has heretofore been capable of providing all different sounds, the musician is forced to choose. The choice is exacerbated by the fact that a musician during his or her career may be engaged to play a wide range of different musical styles. Thus the musician who buys equipment to perform in a heavy metal band would find himself or herself ill-equipped if later invited to play in a blues band or country band. Trading in old equipment to buy new equipment is an expensive option.

To address this, currently several manufacturers offer a so called "modeling" amplifier that mimics the sounds of different types of vintage amplifiers using digital signal processing technology. While modeling amplifier technology is interesting, to many a musician's ear, this modeling technology falls short of the mark.

The present invention addresses the foregoing problems through a unique modular, mix-and-match system that allows a musician to add to his or her amplification arsenal at far lower cost. The modular system allows the musician to add new pre-amplification modules, as needed, thereby gaining new sound production characteristics, at a far lower cost than buying a new amplifier each time. The modular system also advantageously allows the musician to "carry" multiple different amplifications, without the need to lug several heavy amplifiers to the gig.

In addition to providing, a convenient, modular upgrade path, the amplifier system of the invention offers a great deal of flexibility. The signal-routing circuitry associated with chassis is controlled by the user, such as through a MIDI foot switch, to route the input signal through any selective one of the instrument pre-amps that the user has installed. Thus the user can, in effect, "switch amplifiers" from one song to the next. The signal-routing circuitry also allows the signals to be routed so that the output of one module feeds the input of the next. This routing option allows a digital-signal processor module to be physically inserted into one of the modular slots and also musically inserted in the signal path. In one presently preferred embodiment, the chassis automatically senses that an inserted module is an analog or digital signal processing unit, (as opposed to a pre-amplifier), such that the signal routing circuitry automatically places this unit in series with the audio signal path, when selected. The signal processing unit can be any of a variety of processing units, including but not limited to equalizers, compressors, distortion, chorus, flange, wah-wah, tremolo, reverb, echo and more sophisticated digital signal processing units.

For a more complete understanding of the invention, its objects and advantages, refer to the following specification and to the accompanying drawings.

DETAILED DESCRIPTION OF THE PREFERRED EMBODIMENT

Figure 1:
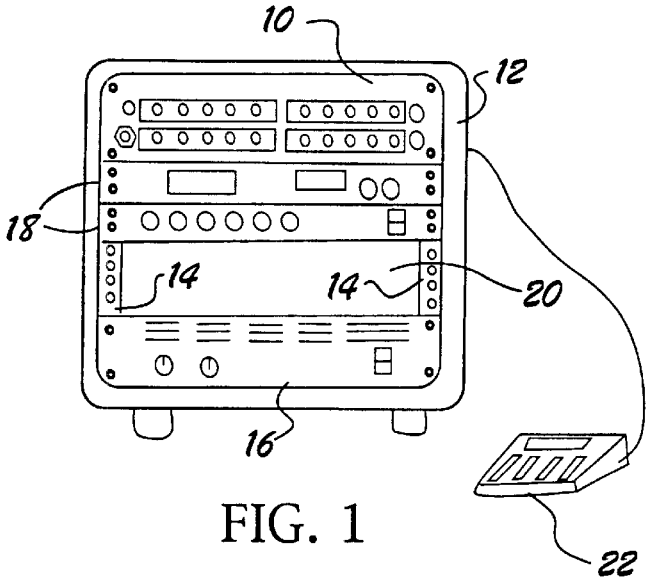
FIG. 1 is a front view of a first embodiment of the modular amplification system, adapted for use in a rack mount configuration.
Figure 3:
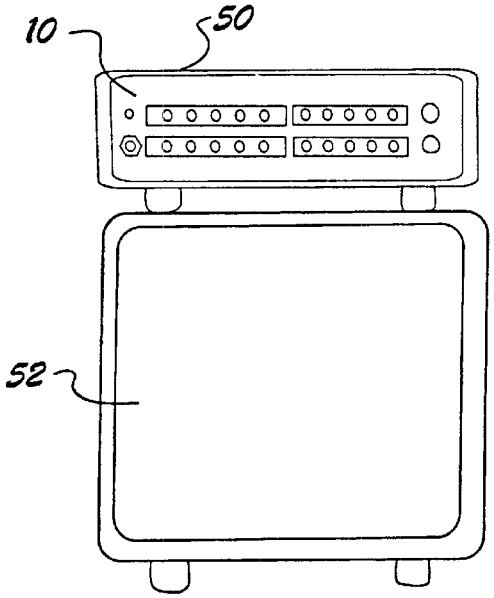
FIG. 3 is a front view of the modular amplification system, adapted for use in a combo amplification system comprising an amplifier head and separate speaker enclosure.
Figure 2:
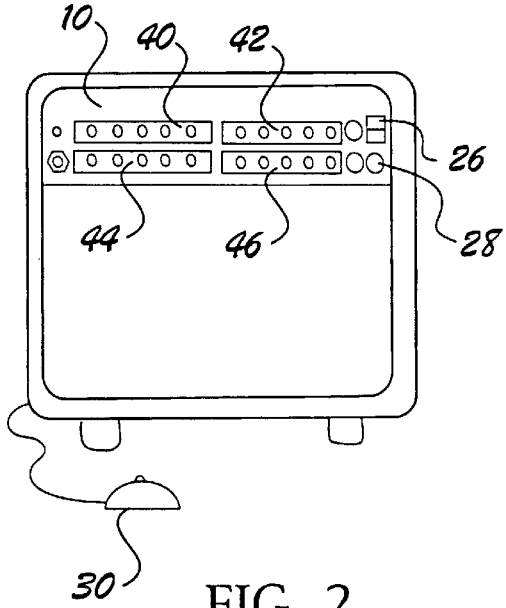
FIG. 2 is a front view of the modular amplification system, adapted for use in an integrated musical instrument amplifier.

FIGS. 1, 2 and 3 illustrate three different physical embodiments of the modular amplification system. In FIG. 1, the modular amplification system 10 is shown in a rack mount configuration. The configuration includes a rack mount shell 12 having rails 14 to which rack mount units are attached with screws or bolts. For illustration purposes, the rack mount configuration of FIG. 1 also illustrates a power amplifier 16 and two outboard effects processors 18 secured within the rack. The empty space 20 above power amplifier 16 represents available space for additional rack mount units. In this configuration, the output of the modular amplification system would be fed to the input of power amplifier 16 and the output of power amplifier 16 would be fed to a suitable speaker enclosure (not shown).

The preferred embodiment of the modular amplification system is designed to work with a variety of different foot pedals, as will be more fully described below. Illustrated in FIG. 1 is a MIDI foot pedal 22 that allows the musician to control operation of the modular amplification system by pressing selected buttons on the foot pedal. Pressing the appropriate footswitch button, the musician selects which preamplifier will be used.

The integrated amplifier embodiment of FIG. 2 includes the modular amplification system in the upper portion of the amplifier enclosure, as illustrated. The integrated amplifier has a self-contained power amplifier and a speaker or speakers. The speakers are disposed behind grill 24 and the power amplifier may be integrated with or attached to the modular amplification system. For illustration purposes, a front panel on/off switch 26 and an additional power amplifier gain control knob 28 are illustrated. Although not required, these additional controls may be desired in some configurations.

The integrated amplifier system illustrated in FIG. 2 includes a simple on/off push-button switch 30 that is connected through an input on the rear panel of the modular amplification system. By momentarily pressing switch 30, the musician is able to control the operation of the modular amplification system. More specifically, the presently preferred embodiment of the amplification system allows the musician to install up to four modular pre-amplification units or modular effects processor units. These four units are shown at 40, 42, 44, and 46 in FIG. 2. By momentarily activating the push-button switch 30, the musician can cycle from one pre-amplification unit to the next, thereby instantly changing which preamplifier will be used.

FIG. 3 illustrates a third embodiment of the modular amplification system 10, in which the amplification system is mounted in a separate head unit 50 that sits atop the speaker enclosure cabinet 52. Aside from having the amplifier section and speaker enclosure section disposed in separate cabinets, the basic configuration of the embodiment of FIG. 3 is electronically the same as the embodiment of FIG. 2.

Figure 4:
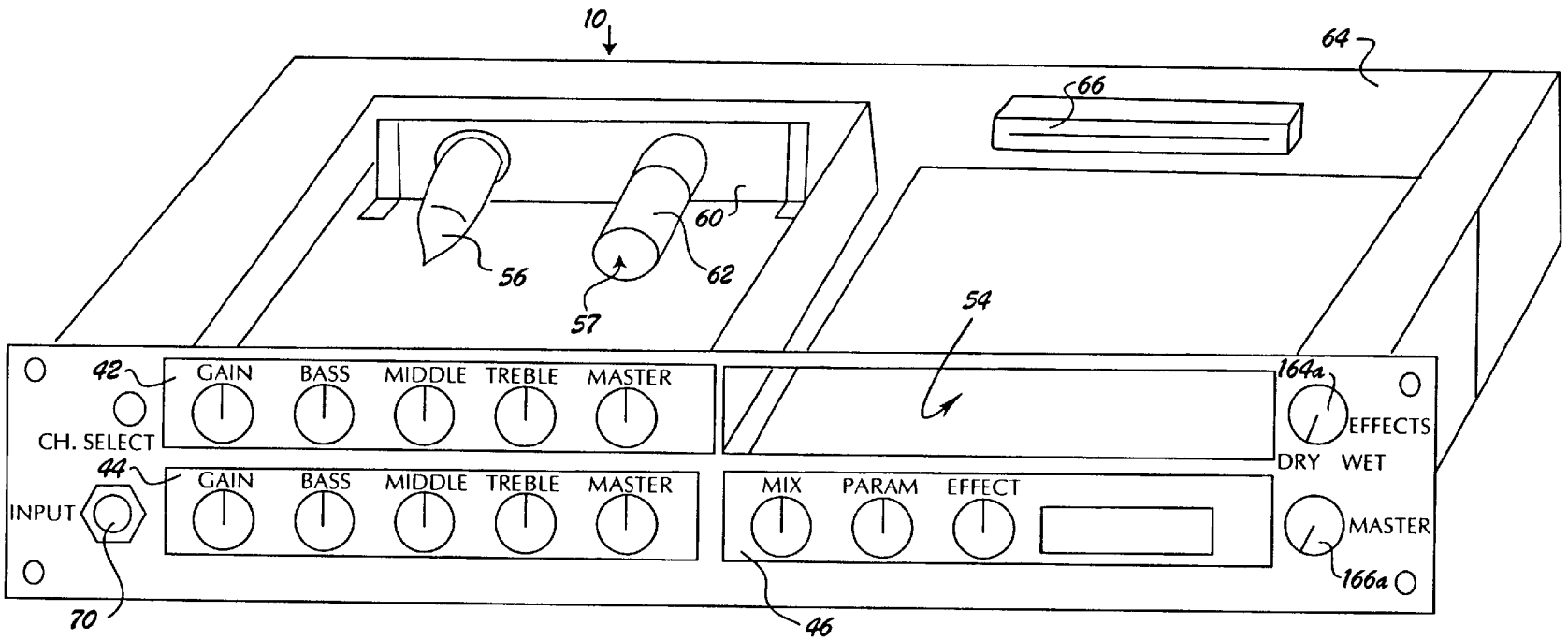
FIG. 4 is a front perspective view of the amplification system, with top cover removed to show the internal configuration.

The modular amplification system 10 is shown in greater detail in FIG. 4. Specifically, a rack mount embodiment is illustrated in FIG. 4. It will, of course, be understood that the other embodiments would similarly fabricated. In the embodiment illustrated in FIG. 4 the top panel of the amplifier system has been removed to reveal the internal components. In addition, the top cover of pre-amplifier module 42 has also been removed to reveal the internal components of that unit. Further note that no pre-amplifier unit is installed in the upper right-hand corner, thereby revealing one of the elongated slotted openings 54.

Each slotted opening is sized to receive a modular unit similar to those shown at 42, 44, and 46. In the illustrated embodiment, modular units 42 and 44 are pre-amplifier units having Gain, Bass, Middle, Treble and Master control knobs. Module 46 is a digital signal processor unit. The slotted opening 54 may be filled with a screw-in or snap-in protective cover when no modular unit is installed. The same is true for the other locations.

The musician has complete flexibility as to which pre-amplifier modules to insert into which of the four locations. In one embodiment, one of the four slotted openings is designated to receive either a pre-amplifier module or an effects processor module. In FIG. 4 the lower right-hand slotted opening (carrying module 46) is designated for this dual function. Of course, any of the four slotted openings could be designed to provide the dual function capability.

In an alternate embodiment, the circuitry is designed to accept either a pre-amplifier module or a signal processing module at any of the four locations. In this alternate embodiment, the circuitry senses which type of module has been installed and routes the audio signals appropriately. Thus a signal processing module is inserted in series with the selected pre-amplifier module or modules, so that the signal processing effects are available for use regardless of which pre-amplifier module the musician has selected.

The pre-amplifier modules can be based on either solid state or vacuum tube design. Many vintage amplifiers employ vacuum tube circuitry, and a large number of musicians still prefer vacuum tube circuitry for the warm distortion that this circuitry provides. Pre-amplifier module 42 thus illustrates how vacuum tube circuitry may be incorporated into the modular packaging. Pre-amplifier module 42 employs two vacuum tubes 56 and 57 that are attached with tube sockets to a stand-off circuit board 60. To minimize hum, the vacuum tubes may be shielded with a suitable cylindrical metal shield as at 62. The shield has been removed from vacuum tube 56 to reveal the vacuum tube.

Figure 5:
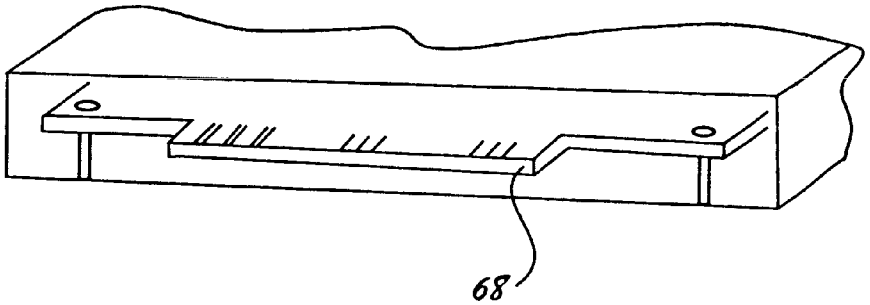
FIG. 5 is a partial perspective view of the rear of one of the modular preamplifier units, illustrating the edge connector.

The modular pre-amplifier units (and effects processors units) attach to the chassis 64 of the modular amplification system 10 using edge connectors. The edge connector associated with slotted opening 54 is shown at 66. The edge connector is designed to receive the posterior edge of the circuit board associated with a modular unit, so that the appropriate circuit board traces make contact with the edge connector 66. Although edge connectors are presently preferred, other suitable mulit-pin connectors may be used. Such connectors include, but are not limited to, multi-pin header connectors, ribbon connectors and the like. FIG. 5 shows how the circuit board of a modular unit is provided with a male edge portion 68 that will insert into the female edge connector 66.

The edge connector supplies power to the modular units and also makes appropriate contact for sending and receiving the audio signals and any necessary data or control signals. Preferably the edge connector is wired so that certain contacts are assigned to certain functions (such as power supply functions, audio signal functions, MIDI data functions, on/off functions, and the like).

Typically a vacuum tube circuit will require a low voltage (e.g. 6 volts or 12 volts) to supply the vacuum tube heaters and a high voltage (e.g. 300 volts DC) to supply the vacuum tube plate and other associated biasing circuitry. A transistor pre-amplifier unit or digital signal processing unit may require other voltages as well. All of these voltages are preferably generated by a common power supply using suitable voltage regulators to supply the needed voltages. A digital device, such as a signal processing unit or a transistorized pre-amplifier device would not require the same voltages as the vacuum tube devices and hence would not make contact with the edge connector contacts carrying those higher voltages. Alternatively, each individual module can have its own voltage regulator circuitry to convert the supply voltages to the proper voltages required.

The pre-amplifier circuits and the digital signal processing circuits typically include at least one audio input and at least one audio output. These inputs and outputs are also provided at the appropriate edge connector terminals. If desired, the edge connectors can be configured so that digital signal processing units are inserted in the audio signal chain (in series with a pre-amplifier). This may be done by assigning certain contacts of the edge connector to the signal insert function. Other contacts used by the pre-amplifier units would connect the input and output of the pre-amplifier with the input and output of the modular amplification system. For more details on signal routing, refer to the circuits description below.

Pre-amplifier units based on vintage amplifier designs typically have fairly simple feature switching requirements.

For example, a vintage pre-amplifier circuit may employ a signal push button switch to engage or disengage a "Bright" toggle switch, or to select between "Rhythm" and "Lead" channels. The switching signals to control these features may be supplied by a simple momentary push-button switch which is connected through suitable contacts on the edge connector. More sophisticated digital modeling amplifiers and digital signal processing units typically require more complex control mechanisms. The presently preferred embodiment supports MIDI control. MIDI control signals are supplied over suitable contacts of the edge connector to devices that utilize MIDI signals. In this way, a MIDI foot pedal can be used to change modeling amplifier characteristics or digital signal processing characteristics either between songs or as the musician is playing.

The modular amplification system is designed with flexibility in mind. Thus, the musician can select the pre-amplifier units of choice (and also the digital signal processing units of choice) and conveniently insert them into the slots provided on the front panel of system 10. Each modular unit provides its own potentiometer controls and switches that are used to control the basic pre-amplifier functions (or digital signal processing functions, as the case may be). Although the pre-amplifier units illustrated in FIG. 4 have the identical configuration: Gain, Bass, Middle, Treble, Master, the illustration is not intended as a limitation. Rather, the pre-amplifier units can have any configuration as desired to provide the functionality of the amplifier it is designed to emulate.

After the musician has inserted the pre-amplifier units of choice into the system 10, the amplifier is ready for use. The musician plugs a musical instrument into input jack 70 and the audio input signal is automatically routed to whichever pre-amplifier unit is currently active. The active pre-amplifier unit may be selected by depressing the channel select button 72 on the front panel or by using a foot switch. Each time the button is pressed, the system steps to the next pre-amplifier unit installed. Any empty slots are simply skipped as the channel select button is pressed.

Figure 6:
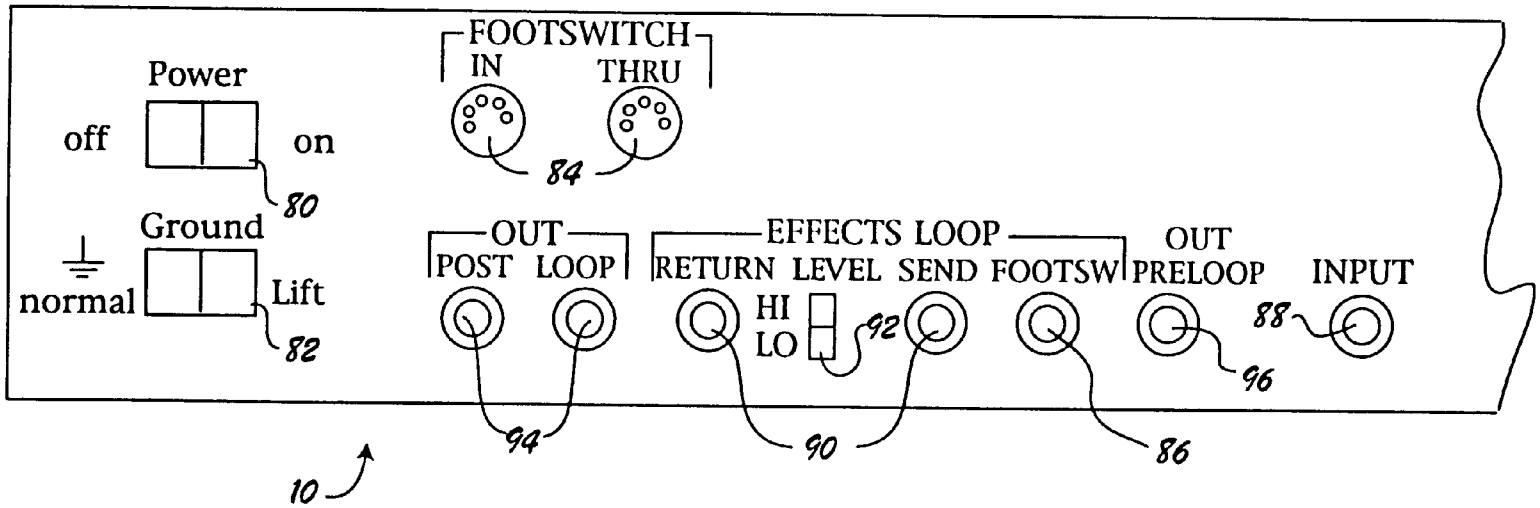
FIG. 6 is a partial rear view of the modular amplification system, illustrating a presently preferred rear panel layout.

The modular amplification system 10 is preferably provided with an assortment of output jacks on the rear panel, as illustrated in FIG. 6. In this regard, FIG. 6 illustrates one possible embodiment. Depending on the actual implementation (rack mount, integrated amplifier, combo amplifier). The rear panel configuration may differ.

Referring to FIG. 6, the power switch 80 turns the modular amplification system on and off, while the ground lift switch 82 disconnects the ground associated with the audio signal path. The ground lift switch is thus used to eliminate ground loops that are sometimes encountered. Ground loops are caused when two or more pieces of audio equipment are connected through plural ground connections producing an undesirable buzz or hum in the audio output.

MIDI Input and Thru jacks are provided at 84 for connection of a MIDI control pedal such as pedal 22. The more simple push button switch (such as push button 30) (FIG. 2) is connected to foot switch input jack 86. Although the preferred embodiment provides an input jack 70 on the front panel (FIG. 4), an additional input jack may be provided as at 88 on the rear panel (FIG. 6).

The remaining inputs and outputs featured on the back panel may be used to connect to power amplifiers (such as amplifier 16 of FIG. 1) or to other outboard effects processors (such as processors 18 of FIG. 1). The preferred embodiment is designed to send and receive audio signals to an effects loop. Thus suitable send and return jacks 90 are provided. Because consumer grade and commercial grade effects processors may have different input signal level requirements, a HI/LO toggle switch 92 is provided in the effects loop. The musician can switch this toggle switch to match the signal requirements of the outboard signal processing equipment he or she is using.

The modular amplification system is able to supply output signals that are derived either after the effects loop or before the effects loop. The output jacks 94 are "post loop" and thus provide an audio output signal that is affected by any devices attached into the effects loop. Output 96 is "preloop" and thus provides a dry signal (not affected by the effects loop).

Figure 7:
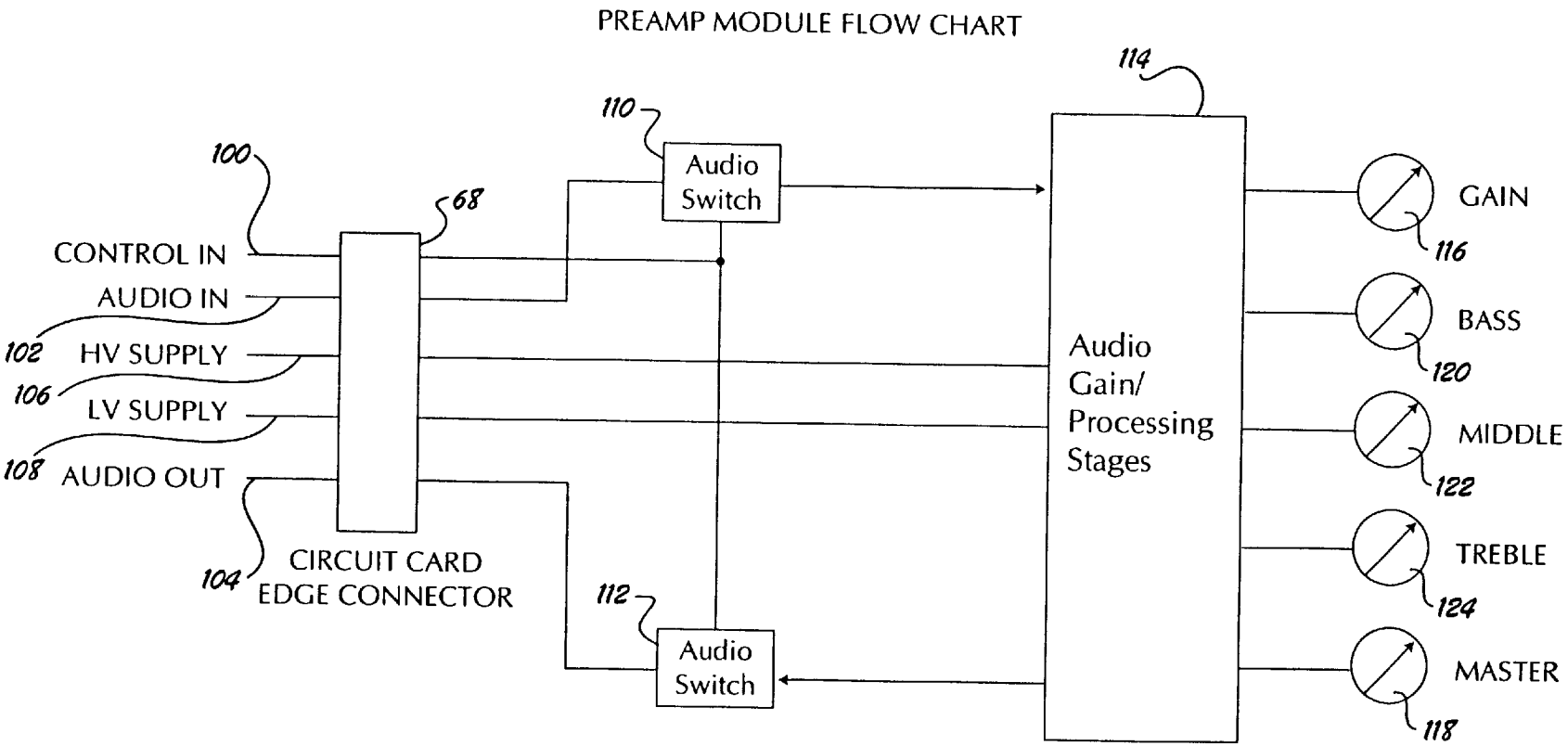
FIG. 7 is a block diagram of the modular preamplifier unit in accordance with the presently preferred embodiment.

Turning now to the circuit diagrams of FIGS. 7 and 8, a further explanation of the preferred signal routing circuitry will now be described. Referring to FIG. 7, an exemplary pre-amplifier module in accordance with the invention derives a plurality of input signals (fed to edge card connector 68) from the modular amplifier system chassis. In the presently preferred vacuum tube pre-amplifier circuit, those input signals include, a control input signal on lead 100, and audio input signal on lead 102, and audio output signal on lead 104 and high and low power supply voltages on leads 106 and 108, respectively.

The input and output signals are fed through audio switches 110 and 112 that are activated by a logic signal on control input lead 100. When the pre-amplifier module is switched into operation, a control signal on lead 100 closes switches 110 and 112, causing the audio input signal to be fed into the gain processing stages 114 via switch 110. The same control signal also switches audio switch 112 into conduction, thereby feeding the output of the gain processing stages 114 to the audio output lead 104.

The audio gain and processing stages have suitable potentiometer controls to adjust the amplifier gain and tone. More specifically, the preferred embodiment provides both input and output gain controls, designated as gain control 116 and master control 118. In many popular pre-amplifier circuits, it is common to provide both gain and master gain controls, so that the pre-amp stage can be overdriven while still maintaining a moderate volume level. The preferred tone control section includes a Bass control 120, a Mid-range control 122 and a Treble control 124.

Note that the audio switches 110 and 112 isolate both the input and the output of the audio gain and processing stages 14. This is done to reduce crosstalk and noise that might otherwise occur due to the close proximity of the pre-amplifier sections within the chassis.

Figure 8:
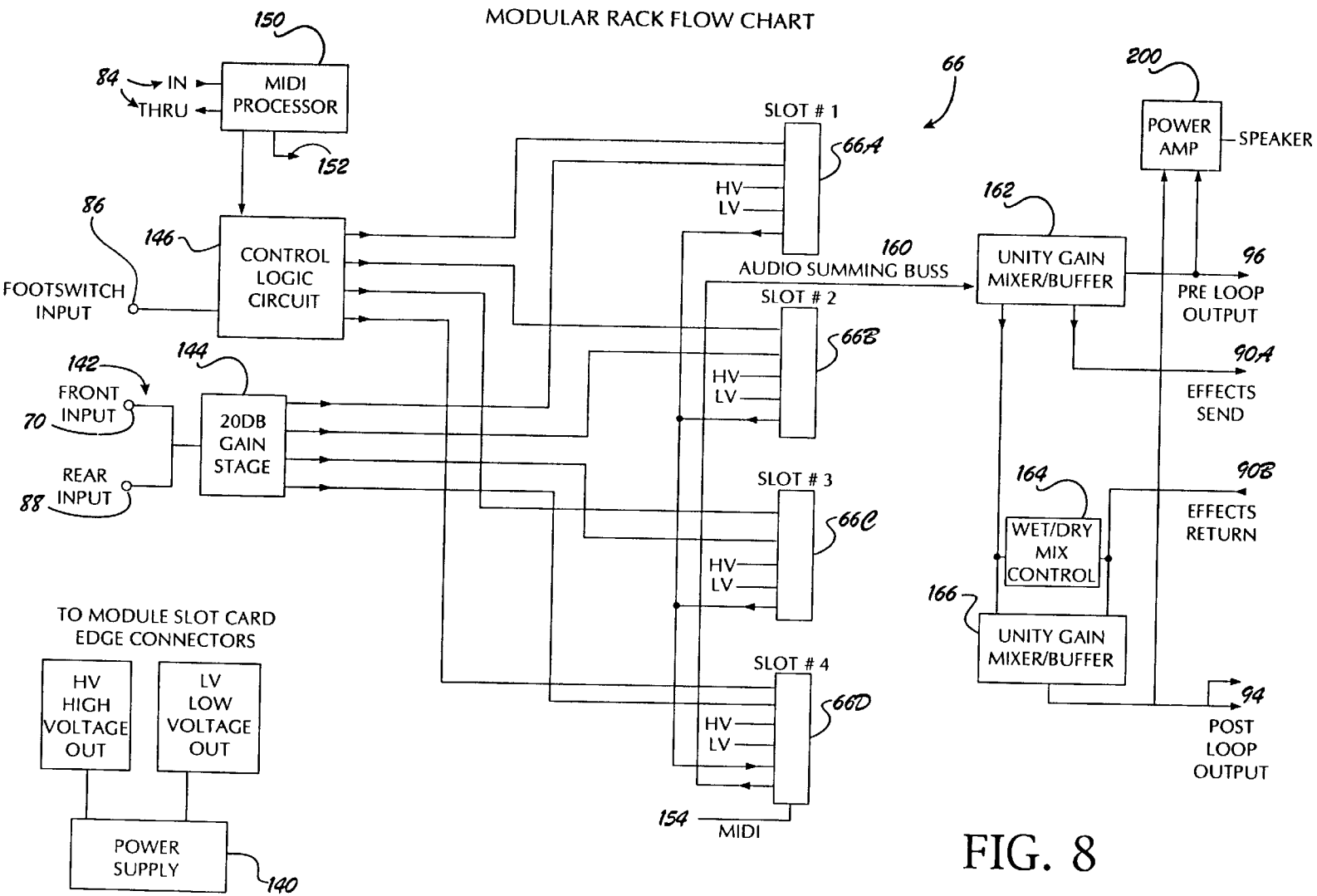
FIG. 8 is a block diagram of the chassis components of the modular amplification system of the presently preferred embodiment.

The circuitry associated with chassis 64 is illustrated in FIG. 8. The power supply 140 supplies both high voltage (HV) and low voltage (LV) power that are respectively supplied to the HV and LV pins of the edge connectors 66. In FIG. 8 the individual edge connectors associated with the four slotted openings have been further designated 66*a–d*. In the illustrated embodiment, the fourth slot (associated with edge connector 66*d*) serves a dual purpose. It can accommodate either a pre-amplifier module or an effects processor module.

The audio input signal is fed as illustrated at 142 from both the front input jack 70 and the rear input jack 88 through a 20db gain stage 144. This gain stage, in turn, feeds the four edge connectors with the audio input signal.

The control logic circuit 146, which may be connected to the foot switch input 86 and also to the MIDI processor 150. MIDI processor 150 receives MIDI input signals on the MIDI input jack 84, decodes those signals, and supplies a control logic signal to the control logic circuit 146. This way either the simple push button foot switch or a MIDI control foot switch can provide switching instructions to the control logic circuit 146.

The control logic circuit, in turn, supplies control input signals to the edge connectors 66 to be supplied to the modules that are plugged into the respective edge connectors. If desired, the MIDI processor 150 can supply an additional MIDI signal on lead 152, which may be routed to an appropriate terminal on the edge connector. In this regard, edge connector 66*d* includes pin 154 that supplies the MIDI control signal. This control signal may be used to change the settings of a MIDI device plugged into that slot. Although only edge connector 66*d* is illustrated with the MIDI signal present, it will be apparent that the MIDI signal can be supplied to all edge connectors, if desired.

Each of the edge connectors 66 provides an audio output terminal that routes the audio signal over an audio summing bus 160 to the unity gain mixer/buffer amplifier 162. This buffer amplifier, in turn, supplies the audio output signal to the effects send jack 90*a* and to the pre loop output jack 96. The effects return jack 90*b* couples the effects return signal through a wet/dry mix control 164 that is used to blend the amount of the effects processed signal with the dry or unprocessed signal. The wet/dry mix control 164 is provided with a suitable control knob illustrated in FIG. 4 at 164*a*. The mix control supplies output signals to the unity gain mixer/buffer 166, which in turn provides the post loop output signal to jack 94. The unity gain mixer/buffer amplifiers 162 and 166 are preferably provided with a level control knob (shown in FIG. 4 at 166*a*). This control knob adjusts the overall master gain to control the level of the signal present on all of the output jacks.

Although it is not necessary to provide a power amplifier stage on chassis 64, such a stage can be added if desired. In FIG. 8 the power amplifier is shown at 200. It receives input signals from the unity gain mixer/buffer amplifiers 162 and 166 and supplies an output to a suitable speaker cabinet. The power amplifier 200 can be mono, stereo or more channels, as desired.

From the foregoing it will be appreciated that the modular amplification system of the invention provide a great deal of flexibility and versatility. The musician can, in effect, build a custom musical instrument amplifier having a variety of different performance characteristics without the need to purchase a multiple complete amplifier systems. The invention thus helps the musician enhance his or her playing styles and musical opportunities without unduly taxing the budget.

While the invention has been shown in its presently preferred embodiments, it will be appreciated that the invention is capable of modification without departing from the spirit of the invention as set forth in the appended claims.

What is claimed is:

1. A modular musical instrument amplification system comprising:

a chassis that defines a plurality of modular slots and supports a plurality of first connectors each associated with one of said modular slots, each of said modular slot, having a first connector;

a plurality of modular preamplifier units for amplifying a musical instrument input signal, at least one of said preamplifier units having amplification and sound coloration properties not shared by at least one other of said preamplifier units, each of said preamplifier units having a second connector for an engagement with one of said first connectors when said preamplifier unit is inserted into one of the modular slots; and a signal routing circuitry coupled to said plurality of first connectors for selecting an output from one of the preamplifier units in order to feed the output signal into a power amplifier.

2. The system of claim 1 wherein said chassis is adapted to be secured to a pair of mounting rails.

3. An integrated musical instrument amplifier having a power amplifier and at least one speaker disposed in a common cabinet, and further comprising the modular musical instrumentation amplification system according to claim 1, said system being disposed in said common cabinet and being coupled to said power amplifier.

4. A musical instrument combo amplifier head comprising a power amplifier disposed in a first cabinet, said power amplifier having at least one output terminal for coupling to at least one speaker external from said first cabinet; and further comprising the modular musical instrumentation amplification system according to claim 1, said system being disposed in said first cabinet and being coupled to said power amplifier.

5. The system of claim 1 wherein said signal routing circuitry includes a control logic circuit that causes one of said plurality of modular preamplifer units to be selectively connected to said output.

6. The system of claim 1 further comprising at least one modular signal processing unit removeably inserted into at least one of said modular slots, said processing unit having a third connector that engages one of said first connectors when said processing unit is inserted into one of the modular slots.

7. The system of claim 6 wherein said preamplifier units each define an audio signal path and wherein said signal routing circuitry couples said processing unit in the audio signal path of at least one of said preamplifier units.

8. The system of claim 6 wherein said modular signal processing unit is connected to a MIDI switch.

9. The system of claim 8 wherein said chassis includes at least one MIDI input port for receiving MIDI control signals and for routing said control signals to said processing unit.

10. The system of claim 1 further comprising at least one power supply associated with said chassis that delivers electric power at least one supply voltage to said first connectors and wherein said modular preamplifier units receive operating power by making contact with said first connectors.

11. The system of claim 1 wherein said signal routing circuitry includes at least one effects loop circuit whereby external signal processing units are coupled in the audio signal path to alter said output signal.

* * * * *